US005838281A

United States Patent [19]

Blaese

[11] Patent Number: 5,838,281

[45] Date of Patent: Nov. 17, 1998

[54] BODY PANEL MOUNT ANTENNA

[76] Inventor: Herbert R. Blaese, 3314 Olcott Ave., Chicago, Ill. 60634

[21] Appl. No.: 714,375

[22] Filed: Sep. 16, 1996

[51] Int. Cl.[6] ..... H01Q 1/32

[52] U.S. Cl. ..... 343/715; 343/711; 343/712

[58] Field of Search ..... 343/715, 711, 343/906, 712; H01Q 1/32

[56] References Cited

U.S. PATENT DOCUMENTS

| | | | |
|---|---|---|---|
| 3,444,313 | 5/1969 | Goodchild, Jr. et al. | 343/906 |
| 3,853,757 | 12/1974 | Kaiser | 343/906 |
| 5,502,452 | 3/1996 | Gomez | 343/715 |

*Primary Examiner*—Hoanganh T. Le

*Attorney, Agent, or Firm*—Gerstman, Ellis & McMillin, Ltd.

[57] ABSTRACT

A body panel mount antenna, for generally mounting in a metal panel of an automobile, is provided. The antenna includes a radiator whip and a mounting assembly and is particularly suitable for use in the frequency range of over 1000 MHz. The mounting assembly provides support for the radiator whip and comprises an electrically conductive conically shaped member. A base for anchoring the antenna to a metal panel is also provided. The base and mounting assembly are attachable through an opening in a metal panel in such a way that the conically shaped member is in continuous positive contact with the metal panel. The contact between the conically shaped member and the metal panel causes the metal plate to act as a ground plane for the antenna.

11 Claims, 3 Drawing Sheets

BODY PANEL MOUNT ANTENNA

FIELD OF THE INVENTION

The present invention concerns a novel body panel mount antenna.

BACKGROUND OF THE INVENTION

Antennas mounted on the roofs of automobiles often provide the users of communications equipment with the best reception of signals that can be achieved in an automobile. Metal surfaced vehicles are natural candidates for body panel mounted antennas because when the antenna is fastened to the surface, the surface becomes electrically joined with the antenna.

The metal surface that the antenna is attached to serves two important purposes; structural and electrical. Electrically the surface on which the antenna is attached acts as a broad band counterpoise or ground plane. Without this metal surface, certain antennas cannot function and should never be installed on any non-conductive surface. Generally, these types of antennas are mounted in the roof panel, and other body panels, by cutting or punching a hole in the panel and attaching the antenna through the hole.

In the functioning of this type of antenna, and particularly in the ground plane, the radio frequency current necessary to the creation of the requisite ground plane must pass through the metal panel of the automobile at the top surface of the panel. Further, this type of antenna functions optimally only when the ground plane energy is allowed to radiate equally out from every point of contact between the ground plane and the antenna. The connection of the antenna base to the entire circumference of the hole cut into the panel produces this precise functioning condition. A precise functioning of the antenna becomes paramount when signal frequencies become very high, as will be explained below.

In prior art metal panel mount antennas, precise connections between the antenna and the metal panel were not achieved. In prior art antennas, the connection of the antenna to the automobile is generally made by a nut and bolt type connection where the antenna base is generally the bolt, attached from within the automobile panel, and a nut is attached from outside the automobile panel to hold the antenna in place. A hole of slightly greater diameter than the diameter of the base of the antenna is cut into the metal panel. Depending on the antenna brand and size, different size holes must be cut. The antenna base is placed into the hole and the nut and antenna base are tightened. It is hoped, when the antenna base and nut are so installed, that a portion of the antenna base will make contact with some portion of the panel.

As the hole in the panel is cut so that the base of the antenna can fit into the hole, the base of the antenna is necessarily of a smaller diameter than the hole. Because the antenna base is smaller than the hole into which it will be installed, the antenna base does not make contact about the entire circumferences of the hole. Further, as the base of the antenna must fit inside of the hole, there is the possibility that the antenna base and the walls defining the hole will not be in contact at all.

Because these antennas must have a ground plane, and because prior art antennas cannot guarantee the connection of the antenna to the metal panel of the automobile to create a ground plane, antenna installers have tried to compensate by cleaning the surface area of the connection of the bolt portion of the antenna and the underside of the metal panel of the automobile. By cleaning the surface area of this connection, the ground current can eventually find its way to the upper surface of the metal panel.

The underside of body panels are usually not clean metal surfaces such as would enable a good electrical connection. The panels are either painted, covered with insulating materials, coated with rustproofing treatments or are dirty. As a result, it is difficult to achieve a good electrical connection. In order to counter this impediment, antenna installers have taken to scraping and polishing the underside of the metal panel so as to allow a good electrical connection between the mount holding the antenna to the panel. However, as noted above, the radio frequency current must pass through the top of the panel to create the necessary ground plane. Although a better electrical connection is created by scraping and cleaning the underside of the body panel, the current must still find its way to the top of the panel to create the ground plane. The problems inherent in the extra distance that the current must travel are explained below.

The extra step, scraping and cleaning, causes the installation of antennas to be more expensive, difficult and time consuming. Further, such action subjects the metal panel to future deterioration as its protective coating of paint, rust proofing materials or insulating materials are removed and the panel can be exposed to the elements.

Further, even though electrical contact can be made in this way, the necessary point of contact between the antenna and the ground plane will vary from installation to installation. The distance from the contact point may vary due, for among other reasons, to the size of the hole or the thickness of the metal panel. The results of the differences in the distances from the contact point has varying and unpredictable effects on different radio frequency situations. For example, in low frequency systems, where wave lengths are very long, the distance from the contact point to the ground plane surface may be considered small, when referenced to the length of the lower frequency wavelengths, and thus cause no problems. However, the same distance may represent a high percentage of a wavelength at high frequencies, where wave lengths are very short, and result in such systems failing to function. Such system failures are particularly likely in frequency ranges approaching and/or exceeding 1000 MHz.

Further, after all of the extra work needed for this type of installation, this type of connection may with time cease working due to the metal panel subsequently becoming corroded or dirty or otherwise losing its electrical connection. This type of installation is also not very reliable in that any given metal panel may not be a flat surface. Such a connection may cause a sporadic ground conduction connection that allows the antenna to work only intermittently. In the worst case, the ground conductor will not be able to conduct through the metal panel and the antenna will not function. These conditions may also occur sometime after the installation as the antenna shifts or is caused to shift due to external forces.

I have discovered a novel body panel mount antenna which has a base that makes contact with the top surface of the entire circumference of the metal about the hole cut into the metal panel and thereby allows for precise reception and transmittal of radio signals. I have discovered that this novel body panel mount antenna works with a wide range of radio frequencies and its installation is reproducible in all metal panels with the same reliable and predictable connection results. Further, the antenna of the present invention will fit into a range of sizes of body panel holes with repeatable, predictable performance regardless of metal thickness, condition or imperfections in the shape of the hole.

It is therefore an object of the present invention to provide a metal panel mount antenna that is inexpensive to manufacture and install and provides ideal contact with the ground plane. Further, the device of the present invention permits the reproduction of repeatable, predictable signal results in every metal panel, within a reasonable range of thicknesses, into which it is installed and into a range of hole sizes within the metal panels. Also, the present invention allows the use of near microwave frequency radio signal communications with no detuning of the antenna. The present invention is particularly effective in frequencies above 1000 MHz.

Other objects and advantages of the present invention will become apparent as the description proceeds.

SUMMARY OF THE INVENTION

In accordance with the present invention, a body panel mount antenna, for mounting in a metal panel, is provided. The antenna includes a radiator whip and a mounting assembly. The mounting assembly provides support for the radiator whip and comprises an electrically conductive conically shaped member. A base for anchoring the antenna to a metal panel is also provided. The base and mounting assembly are attachable through a metal panel defining an opening such that the conically shaped member is in continuous positive contact with the outside of the metal panel. The contact between the conically shaped member and the metal panel causes the metal panel to act as a ground plane for the antenna. As used in the specification and claims herein, the term "conically shaped member" refers to a member in which the surface tapers and has a generally circular cross-sectional configuration or a cross-sectional configuration that generally corresponds to the shape of the hole.

In the antenna of the present invention, the antenna makes contact at every point along the opening in the metal panel. As a result, ground current is allowed to travel from a ground conductor of the transmission line to the ground plane, the metal panel onto which the antenna is installed, by a direct path. Further, the conically shaped member of the antenna of the present invention causes the ground current to enter the ground plane directly at the outer surface of the metal panel and allows the current to propagate into the panel from every point of contact around the entire surface of the mounting hole.

Because of the conically shaped member, the antenna of the present invention will fit into a range of openings in a metal panel. The antenna can fit into any opening having a diameter ranging from the diameter of the most narrow section of the cone section to the diameter of the widest section of the cone section. The joining of the antenna to its base causes the conical section to contact every part of the cut top edge of the hole in the metal panel. Further, even if the hole in the metal panel is not perfectly round, the conical section will adjust, as the antenna and base are tightened, so that it is in contact with the edge of the hole.

A more detailed explanation of the invention is provided in the following description and claims and is illustrated in the accompanying drawings.

DETAILED DESCRIPTION OF THE ILLUSTRATIVE EMBODIMENT

Figure 1:
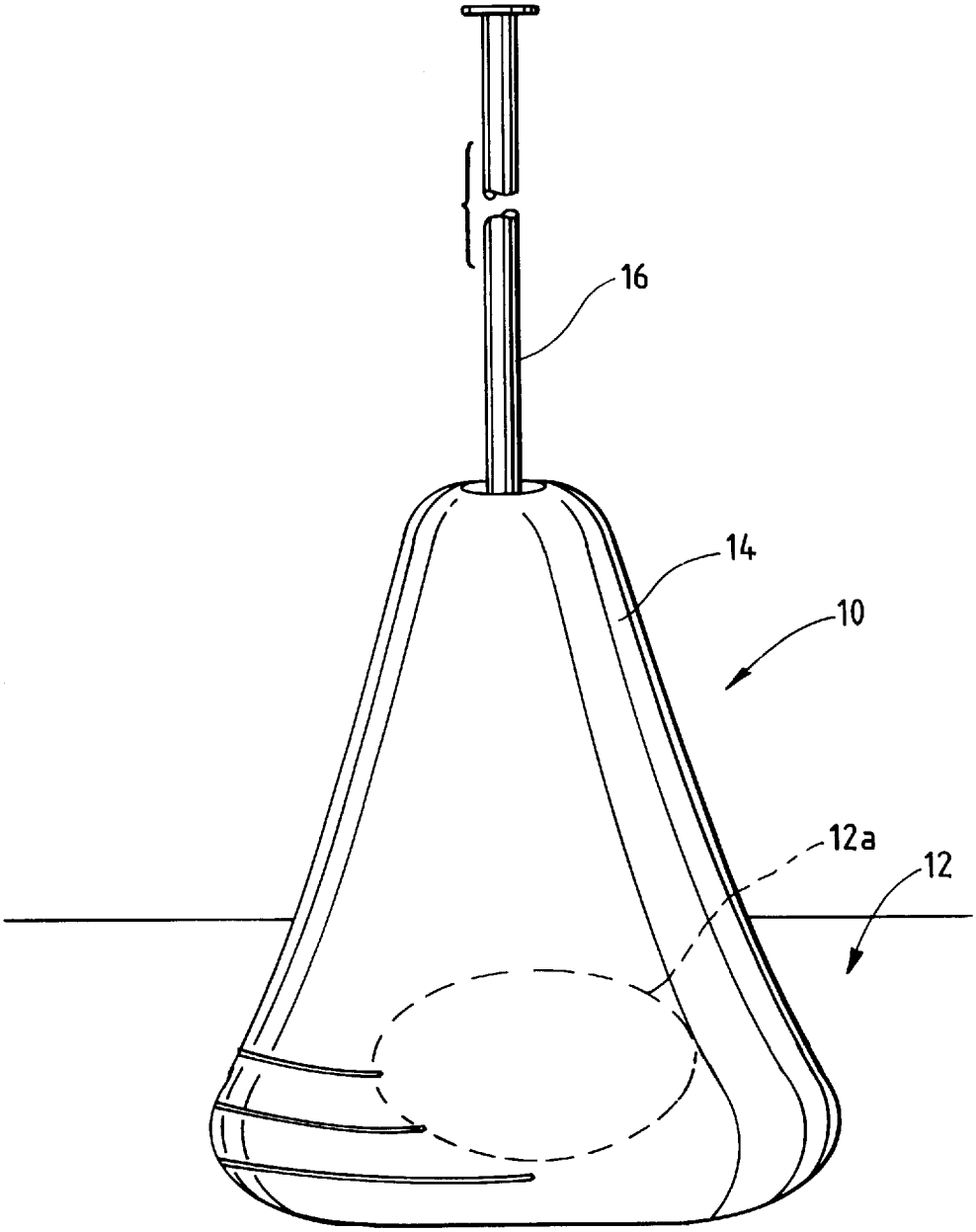
FIG. 1 is a perspective view of a body mount antenna made in accordance with the teachings of the present invention.

Referring to the drawings, FIG. 1 shows a body panel antenna 10 attached to a metal body panel, or ground plane, 12 through a hole 12*a* in panel 12. The body panel antenna 10 is comprised of a top insulator 14 and an antenna whip radiator 16. The interior of the antenna 10 can be seen in FIG. 2.

Figure 2:
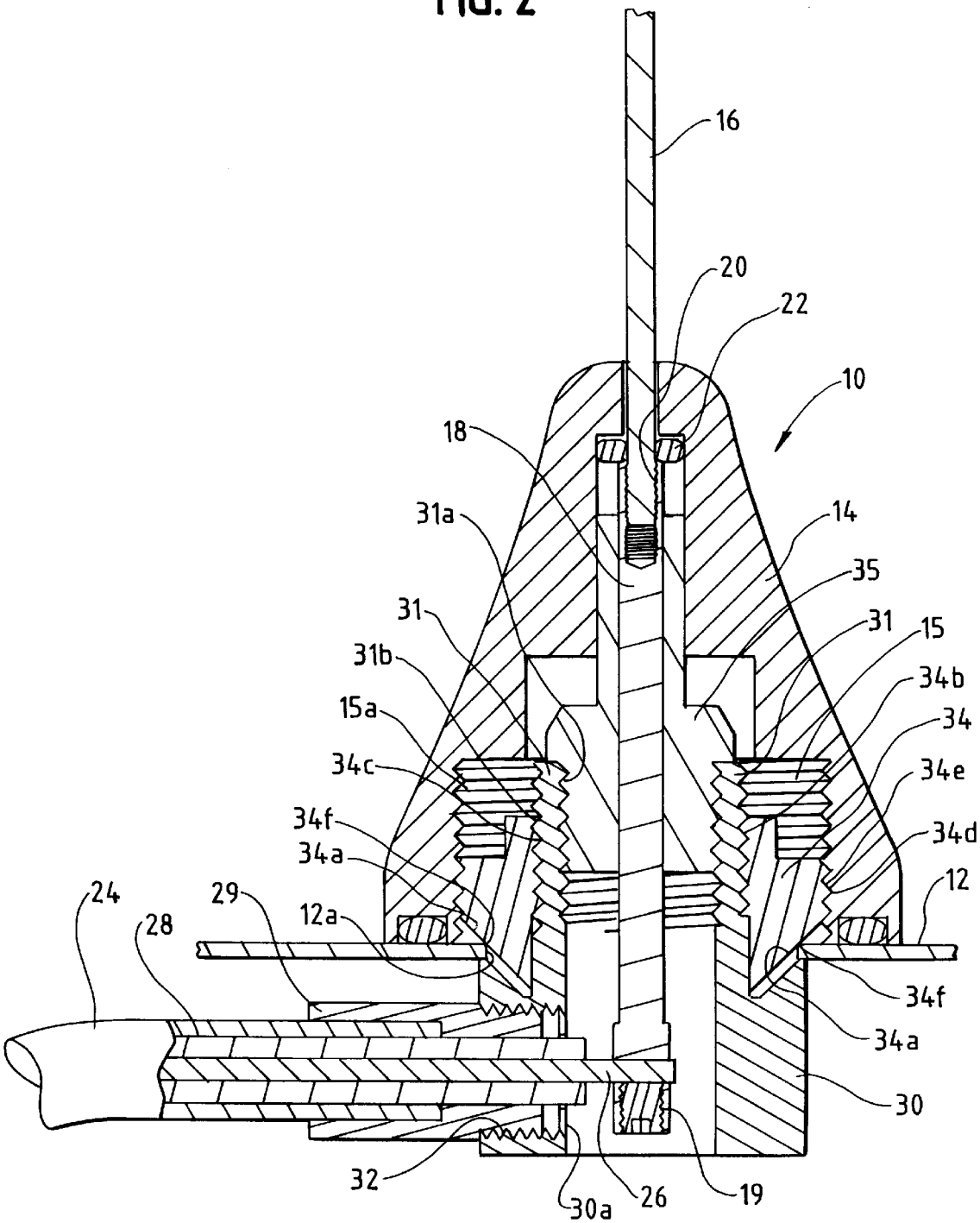
FIG. 2 is cross sectional view of the antenna of FIG. 1.

Referring to FIG. 2, the antenna 10 further comprises a center pin 18 which defines a center cavity 20 into which whip radiator 16 may be rotatably fixed so as to produce a conductive connection between whip radiator 16 and center pin 18. An O-ring 22 is provided at the top of center pin 18 to protect the interior of antenna 10 from the elements. A second O-ring 23 is provided at the bottom of top insulator 14, where top insulator 14 meets metal panel 12, so as to protect the interior of antenna 10 and hole 12*a*, and the interior of the vehicle on which the antenna is installed, from the elements. Top insulator 14 comprises an interior cavity 15 having an interiorly threaded sleeve 15*a*.

A coaxial cable 24, having a main conductor 26, a braided sheath 28 and cable strain relief connector 29, connected to said braided sheath 28, is also provided and is connected to a communication device, not shown. Center pin 18 is connected to the main conductor 26 of the coaxial cable 24 by means of a set screw 19.

As is known in the art, braided sheath 28 acts as a concentric ground conductor. The connection of braided sheath 28 to cable strain relief connector 29 allows the connection of the ground conductor to a ground plane 12, as will be explained in greater detail below.

A base bottom 30 is provided to anchor antenna 10 to metal panel 12. In the illustrative embodiment, base bottom 30 is constructed of electrically conductive material. However, it is possible to construct base bottom 30 of any material and incorporate electrically conductive components therein. Base bottom 30 comprises a sleeve 31 having interior threadings 31*a* and exterior threadings 31*b*. Base bottom 30 further defines an opening 32 in one of its walls 30*a*. Coaxial cable 24 is attached by connector 29 to base bottom 30 at opening 32. In this manner coaxial cable 24 is completely connected to antenna 10; main conductor 26 being connected to center pin 18 and braided sheath 28, the ground conductor, being attached to base bottom 30.

Antenna 10 further comprises a base top 34 having a conical shape portion 34*a* at its lower end, conical shape portion 34*a* being made of electrically conductive material. Base top 34 is designed to hold the upper portion of antenna 10 to the metal panel 12 with the assistance of base bottom 30. Although base top 34 is illustrated as a separable component, from much of antenna 10, any number of configurations of antenna 10 having base top 34 can be used including configurations where base top 34 is an integral part of top insulator 14. In the preferred embodiment, conical shape portion 34*a* may be fitted into any size hole between ½ and ¾ inch in diameter, but it is to be understood that a device encompassing the teachings of the present invention can be made to fit smaller and larger holes.

In the illustrative embodiment, base top 34 comprises a threaded bore 34*b* having threading 34*c*. Threadings 34*c* meet and are threadingly engaged to the exterior threadings 31*b* of base bottom 30. Base top 34, is further threadingly engaged to top insulator 14, in threaded sleeve 15*a*, by threadings 34*d* on the outer edge walls 34*e* of base top 34. Base bottom 30 is also threadingly engaged to center pin 35. Center pin insulator 35 protects center pin 18 from contact with base bottom 30. Insulator 35 is provided, in part, as contact between base bottom 30 and center pin 18 could cause a short circuit of the antenna.

Conical shape portion 34*a* of base top 34 makes contact with the metal panel 12 at a contact point 34*f*. Contact point 34*f* actually defines a conical section having the shape generally identical to the hole 12*a* defined in metal panel 12. Contact is continuous between metal panel 12 and the shape defined by points 34*f* all along conical shape portion 34*a*.

It should be noted that although the illustrative embodiment shows that the base top 34 comprises a conically shaped portion 34*a*, it is to be understood that the base bottom 30 could be formed to have a conical shaped portion that would touch hole 12*a* in metal panel 12 in a similar manner. As it is well known in the antenna art that current travels in the outer surface of the metal panel 12, the connection as shown in the illustrative embodiment is the preferred connection, as will be explained below.

When communication is occurring, ground current is caused to flow from braided sheath 28 (the ground conductor) to cable strain relief connector 29 and into base bottom 30. The ground current is then transferred to base top 34 and subsequently to metal panel 12 at contact points 34*f*. The ground current is thus delivered to metal panel 12 which allows the ground current to radiate.

Figure 4:
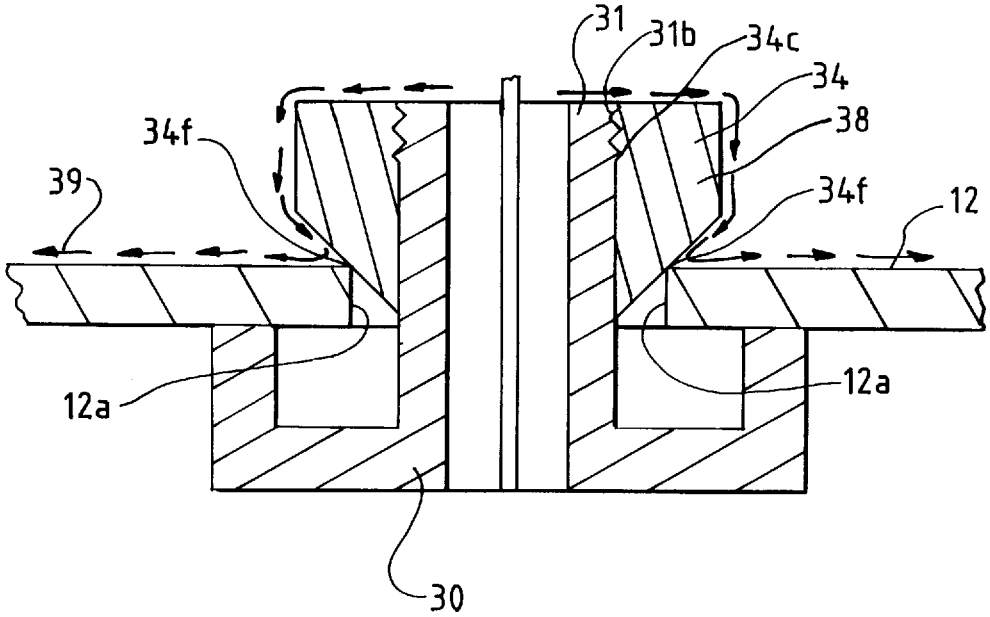
FIG. 4 is a partial cross sectional view of the antenna mounting of the present invention.

In the installation of the illustrative embodiment of the present invention, a hole 12*a* is drilled or punched into a metal panel 12 and base bottom 30 is placed under metal panel 30 so that it is directly beneath hole 12*a*. The entire upper structure of antenna 10 is attached to base bottom 30 through hole 12*a* by base top 34. Base top 34 and base bottom 30 attach to each other by means of threadings 34*c* on base top 34 and 31*b* on base bottom 30. As base bottom 30 and base top 34 are threaded together, conical portion 34*a* is drawn down into hole 12*a* and pressed against the edge of hole 12*a* along the entire circumference defined by points 34*f*. In this way ideal electrical contact is made between antenna 10 and metal panel 12. This contact is more clearly shown in FIG. 4, where a cross-section of likely electrical flow is illustrated by arrows 38.

Figure 3:
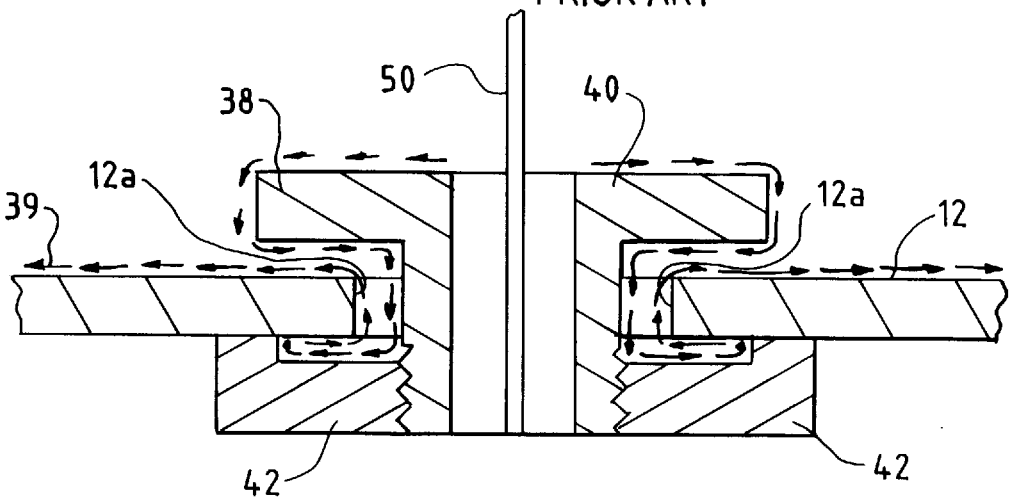
FIG. 3 PRIOR ART
FIG. 3 is a partial cross sectional view of the antenna mounting of a prior art antenna.

FIG. 3 illustrates the manner in which current may flow in the prior art antenna systems. It can be seen that an antenna base top 40 and an antenna base bottom 42 of a prior art antenna are joined together. A metal panel 12 defining a hole 12*a* is also illustrated. Because the base top 40 of the prior art antenna is cylindrical in shape and because hole 12*a* has been cut to allow base top 40 to fit into hole 12*a*, hole 12*a* has too large a circumference to allow base top 40 to touch the walls of hole 12*a*. Current must, therefore, flow from base top 40 to metal panel 12 by taking the circuitous route, illustrated by arrows 39 shown in FIG. 3. As can be seen in FIG. 3, the circuitous route also includes the thickness of metal panel 12 as the current must flow at the upper surface of metal panel 12. It can be seen in FIG. 4 that current may take a more direct route, from the antenna to the ground plane, in the device of the present invention. While the illustrative embodiment of the present invention is designed to accommodate high frequencies, particularly in the range of approximately 1700 MHz to 2400 MHz, it is to be understood that device encompassing the teachings of the present invention will also be effective at higher and lower frequency ranges.

Although an illustrative embodiment of the invention has been shown and described, it is to be understood that various modifications and substitutions may be made by those skilled in the art without departing from the novel spirit and scope of the invention.

What is claimed is:

1. A body panel mount antenna, for mounting in a metal panel, comprising:

a radiator whip;

a mounting assembly supporting said radiator whip, said mounting assembly also comprising an electrically conductive conically shaped member;

a base for anchoring said body panel mount antenna to a metal pane;

said base and mounting assembly being attachable to said metal panel having a wall defining an opening such that said conically shaped member is in continuous positive contact with said wall in said metal panel and said metal panel acts as a ground plane for said antenna.

2. The body panel mount antenna of claim 1 wherein said metal panel is a metal panel of an automobile.

3. The body panel mount antenna of claim 1 wherein said opening in said body panel wall has a diameter having a range in size of between ½ and ¾ inches.

4. The body panel mount antenna of claim 1 wherein said antenna is suitable for use at frequencies in the range of about 1700 MHz to 2400 MHz.

5. A body panel mount antenna, for mounting in an automobile panel, comprising:

a radiator whip;

a mounting assembly supporting said radiator whip, said mounting assembly also comprising an electrically conductive conically shaped member;

a base for anchoring said body panel mount antenna to a metal automobile panel;

said base and mounting assembly being attachable to said metal panel having a wall defining an opening, having a diameter of between ½ and ¾ inches, such that said conically shaped member is in continuous positive contact with said wall in said metal panel and said metal panel acts as a ground plane for said antenna.

6. A body panel mount antenna, for mounting in a metal panel, comprising:

a radiator whip;

a mounting assembly supporting said radiator whip;

a base for anchoring said body panel mount antenna to a metal panel, said base also comprising an electrically conductive conically shaped member;

said base and mounting assembly being attachable to said metal panel having a wall defining an opening such that said conically shaped member is in continuous positive contact with said wall in said metal panel and said metal panel acts as a ground plane for said antenna.

7. The body panel mount antenna of claim 6 wherein said metal panel is a metal panel of an automobile.

8. The body panel mount antenna of claim 6 wherein said opening in said body panel wall has a diameter having a range in size of between ½ and ¾ inches.

9. The body panel mount antenna of claim 6 wherein said antenna is suitable for use at frequencies in the range of about 1700 MHz to 2400 MHz.

10. A method of mounting an antenna to a metal body panel which comprises the steps of:

providing a hole in a metal body panel;

providing an antenna mounting member having a tapering surface with a cross-section corresponding to the shape of said hole;

securing said antenna mounting member to said body panel through said hole; and securing an antenna to said mounting member.

11. The method of mounting an antenna to a metal body panel of claim 10 including the steps of:

providing a base member for attachment of said mounting member to said body panel; and tightening said base member to said antenna mounting member such that the edges defined by said hole in said metal body panel are in continuous positive contact with the circumference of a cross-section of said antenna mounting member.

* * * * *